US010882350B2

(12) United States Patent
Jaspers

(10) Patent No.: US 10,882,350 B2
(45) Date of Patent: Jan. 5, 2021

(54) WEIGHT LOSS JOURNAL AND METHOD OF USE

(71) Applicant: Davis W. Jaspers, Joliet, IL (US)

(72) Inventor: Davis W. Jaspers, Joliet, IL (US)

( * ) Notice: Subject to any disclaimer, the term of this patent is extended or adjusted under 35 U.S.C. 154(b) by 0 days.

(21) Appl. No.: 16/378,747

(22) Filed: Apr. 9, 2019

(65) Prior Publication Data

US 2020/0254806 A1 Aug. 13, 2020

Related U.S. Application Data

(60) Provisional application No. 62/802,264, filed on Feb. 7, 2019.

(51) Int. Cl.

| | |
|---|---|
| ***B42D 3/12*** | (2006.01) |
| ***B42D 3/18*** | (2006.01) |
| ***B42D 1/00*** | (2006.01) |
| ***B43L 1/00*** | (2006.01) |

(52) U.S. Cl.

CPC ..... *B42D 1/008* (2013.01); *B42D 3/12* (2013.01); *B42D 3/18* (2013.01); *B43L 1/00* (2013.01)

(58) Field of Classification Search

CPC ..... B42D 3/12; B42D 3/18
USPC ..... 281/30; D19/81, 26–31
See application file for complete search history.

(56) References Cited

U.S. PATENT DOCUMENTS

| | | | | | |
|---|---|---|---|---|---|
| 637,889 | A * | 11/1899 | Parker | B42D 3/12 | 281/30 |
| 741,878 | A * | 10/1903 | Bogart | B42D 1/004 | 281/15.1 |
| 1,536,937 | A * | 5/1925 | Schafer | B42D 5/028 | 281/30 |
| 4,511,274 | A * | 4/1985 | Chen | B42F 13/16 | 402/19 |
| 4,566,721 | A * | 1/1986 | Friedman | B42D 3/12 | 281/29 |
| 5,011,188 | A * | 4/1991 | Zoland | B42D 3/12 | 281/30 |
| 5,029,899 | A * | 7/1991 | Schieppati | B42D 3/12 | 281/3.1 |
| 5,190,317 | A * | 3/1993 | Zoland | B42D 3/12 | 281/30 |
| D560,719 | S * | 1/2008 | Wehmeyer | D19/26 | |
| 2018/0141368 | A1* | 5/2018 | Donati | B42B 5/123 | |
| 2019/0092073 | A1* | 3/2019 | Epstein | B42D 3/12 | |

* cited by examiner

*Primary Examiner* — Kyle R Grabowski
(74) *Attorney, Agent, or Firm* — Pauley Erickson & Swanson

(57) ABSTRACT

A journal book including wet erase pages releasably bound between a front cover and a back cover. The back cover includes an extension extending past the pages and beyond a corresponding front edge of the front cover. A pen catch is formed in the extension to hold a wet erase pen to the journal, adjacent to the pages opposite a binding. The pen is clipped on the pen catch with a portion of the extension between a pen clip and a pen body.

20 Claims, 4 Drawing Sheets

WEIGHT LOSS JOURNAL AND METHOD OF USE

CROSS REFERENCE TO RELATED APPLICATION

This application claims the benefit of U.S. Provisional Patent Application, Ser. No. 62/802,264, filed on 7 Feb. 2019. The provisional application is hereby incorporated by reference herein in its entirety and is made a part hereof, including but not limited to those portions which specifically appear hereinafter.

BACKGROUND OF THE INVENTION

This invention relates generally to a journal and, more particularly, to a reusable journal for recording notes and/or progress, such as for weight loss or other self-improvement uses or programs.

Record keeping during weight loss or other exercise programs is generally considered a good practice to help maintain good behavior patterns, identify bad behavior patterns, and otherwise keep the participant on track. During some programs, records are to be kept throughout the day, thereby requiring the journal to travel with the participant. In addition, many people prefer to be able to repeat a diet program a further time, or (unfortunately) may need to restart a program due to a lapse in effort. There is a need for improved journals for daily and/or repeated use.

SUMMARY OF THE INVENTION

A general object of the invention is to provide an improved journal for use in tracking daily or weekly activities. This general object of the invention can be attained, at least in part, through a journal book including a front cover, a back cover, and a binding securing a first front edge of the front cover to a corresponding first back edge of the back cover. A plurality of pages are secured to the binding between the front cover and the back cover. The book includes a pen catch extending from the back cover at a back edge different from the first back edge.

The invention further includes a journal book including a front cover, a back cover, and a binding securing a first front edge of the front cover to a corresponding first back edge of the back cover. The back cover includes an extension extending beyond a corresponding front edge of the front cover, and a pen catch formed in the extension. A plurality of wet erase pages are secured to the binding between the front cover and the back cover, and a wet erase pen including a pen body and a clip extending therefrom, is clipped on the pen catch with a portion of the extension between the clip and the pen body.

Other objects and advantages will be apparent to those skilled in the art from the following detailed description taken in conjunction with the appended claims and drawings.

DETAILED DESCRIPTION OF THE INVENTION

Figure 1:
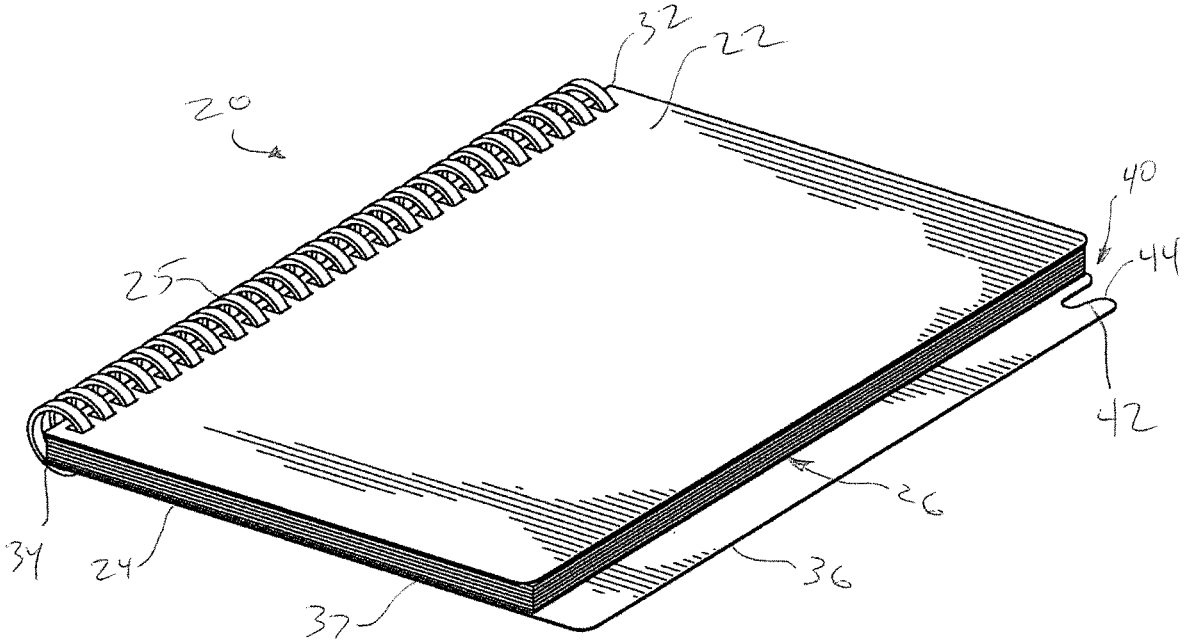
FIG. 1 shows a perspective view of a journal book according to one embodiment of this invention.
Figure 4:
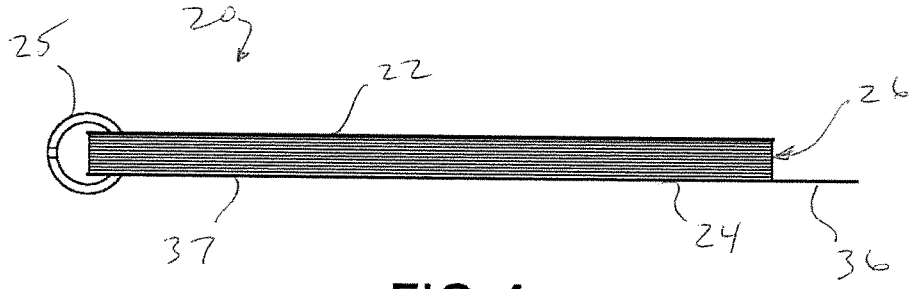
FIG. 4 shows a bottom end view of the journal book of FIG. 1.
Figure 2:
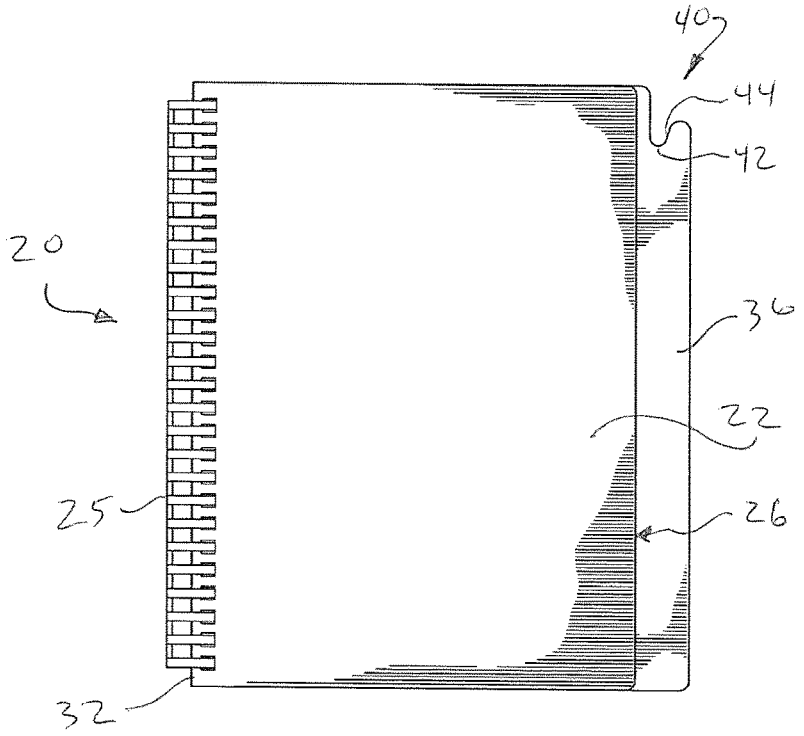
FIG. 2 shows a front view of the journal book of FIG. 1.
Figure 3:
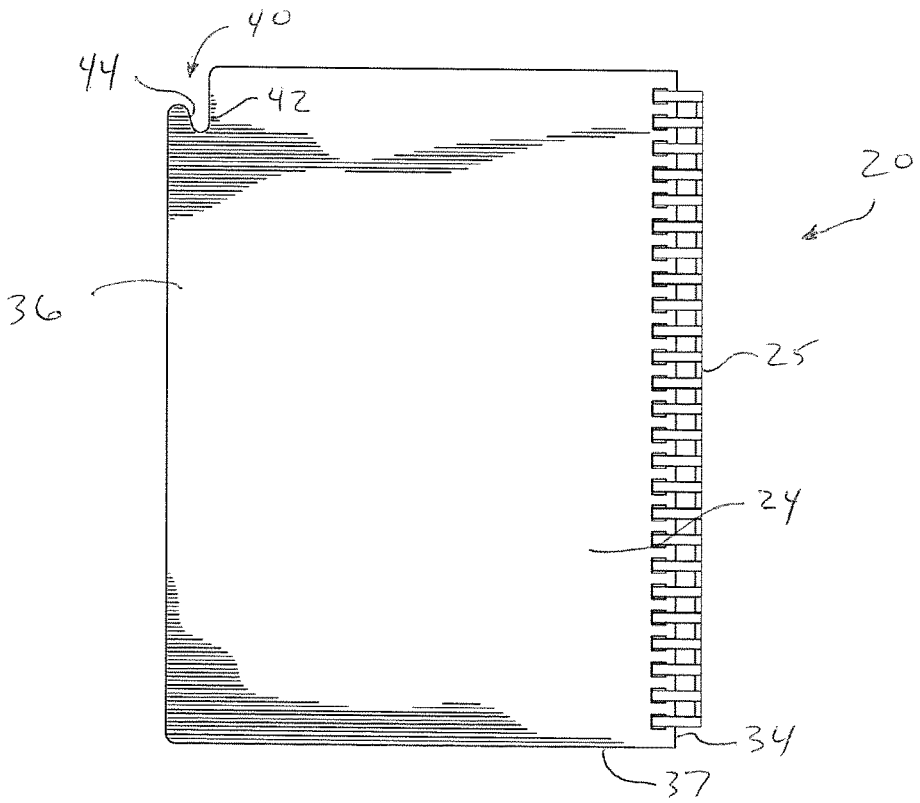
FIG. 3 shows a back view of the journal book of FIG. 1.
Figure 5:
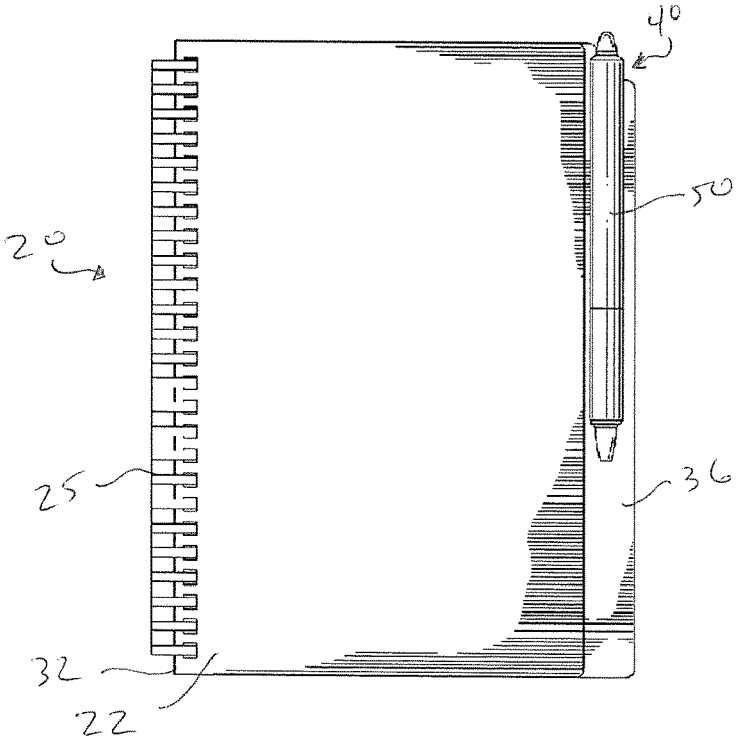
FIG. 5 shows a front view of the journal book of FIG. 1, with a writing instrument.
Figure 6:
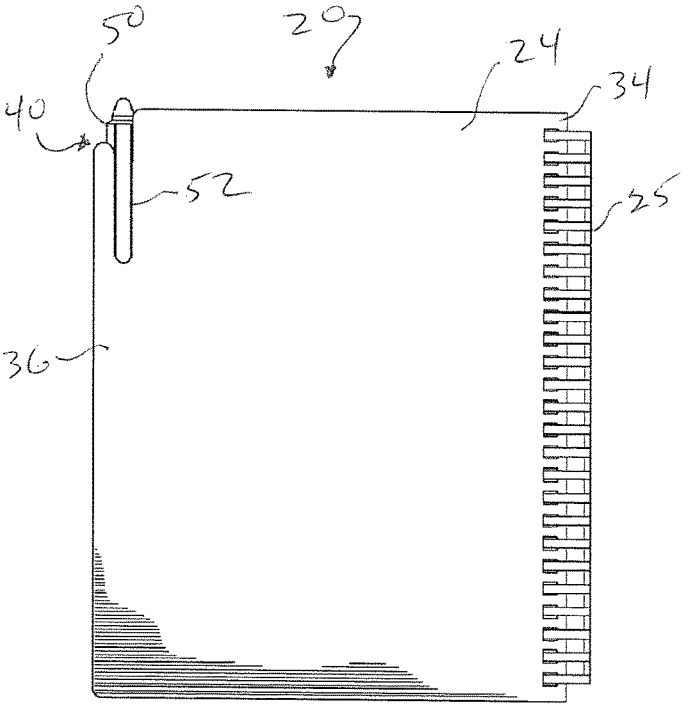
FIG. 6 shows a back view of the journal book of FIG. 1, with the writing instrument.
Figure 7:
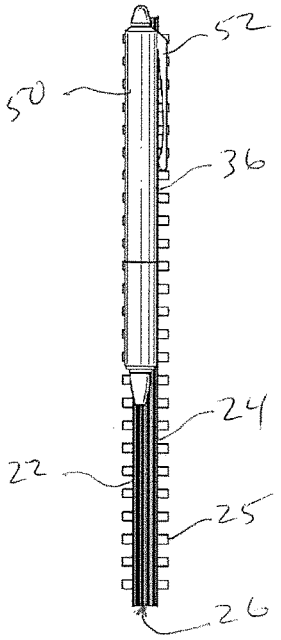
FIG. 7 shows a side or end view of the journal book of FIG. 1, with the writing instrument.

FIGS. 1-8 illustrate a journal book 20 according to one embodiment of this invention. The book 20 includes a front cover 22 opposite a back cover 24. A binding 25 secures a first front edge 32 of the front cover 22 to a corresponding first back edge 34 of the back cover 24. A plurality of pages 26 are secured to the binding 25 between the front cover 22 and the back cover 24.

The book 20 includes a pen catch 40 for securing a pen 50, such as shown in FIGS. 5-8. The pen catch allows the pen 50, such as a specific type of pen for the journal as discussed below, to be more easily retained with the book 20, such as when carried to record diet information throughout the day. The pen catch 40 desirably extends from the back cover, such as at a second back edge that is opposite edge 34.

In embodiments of this invention, the pen catch 40 is integral with the back cover 24. As shown, the back cover 24, and more particularly edge, includes an extension 36. The extension 36 extends beyond the pages 26 and also extends beyond a corresponding front edge 38 of the front cover 22. The extension 36 is parallel to, and desirably colinear with, the rest of the back cover 24. The extension 36 is shown as extending along a full length of the back cover 24, but can alternatively stop short of the bottom edge 37.

In embodiments of this invention, the pen catch 40 includes a notch 42 in the extension 36 of the back cover 24. As shown in FIGS. 5-8, the notch 42 is configured to receive a clip 52 of a writing instrument, such as pen 50. The notch 42 provides a place for the pen 50 to clip and limits the movement of the pen 50 to a single direction, thereby better securing the pen 50 and otherwise limiting unintentional sliding off the extension 36 in a lateral direction. As shown the pen catch includes a notch undulation 44 at the corner of the extension 36, forming a J or hook shape. As will be appreciated variations on the undulation are available, such as sharper angles instead of rounded, or a square/rectangular notch.

Figure 8:
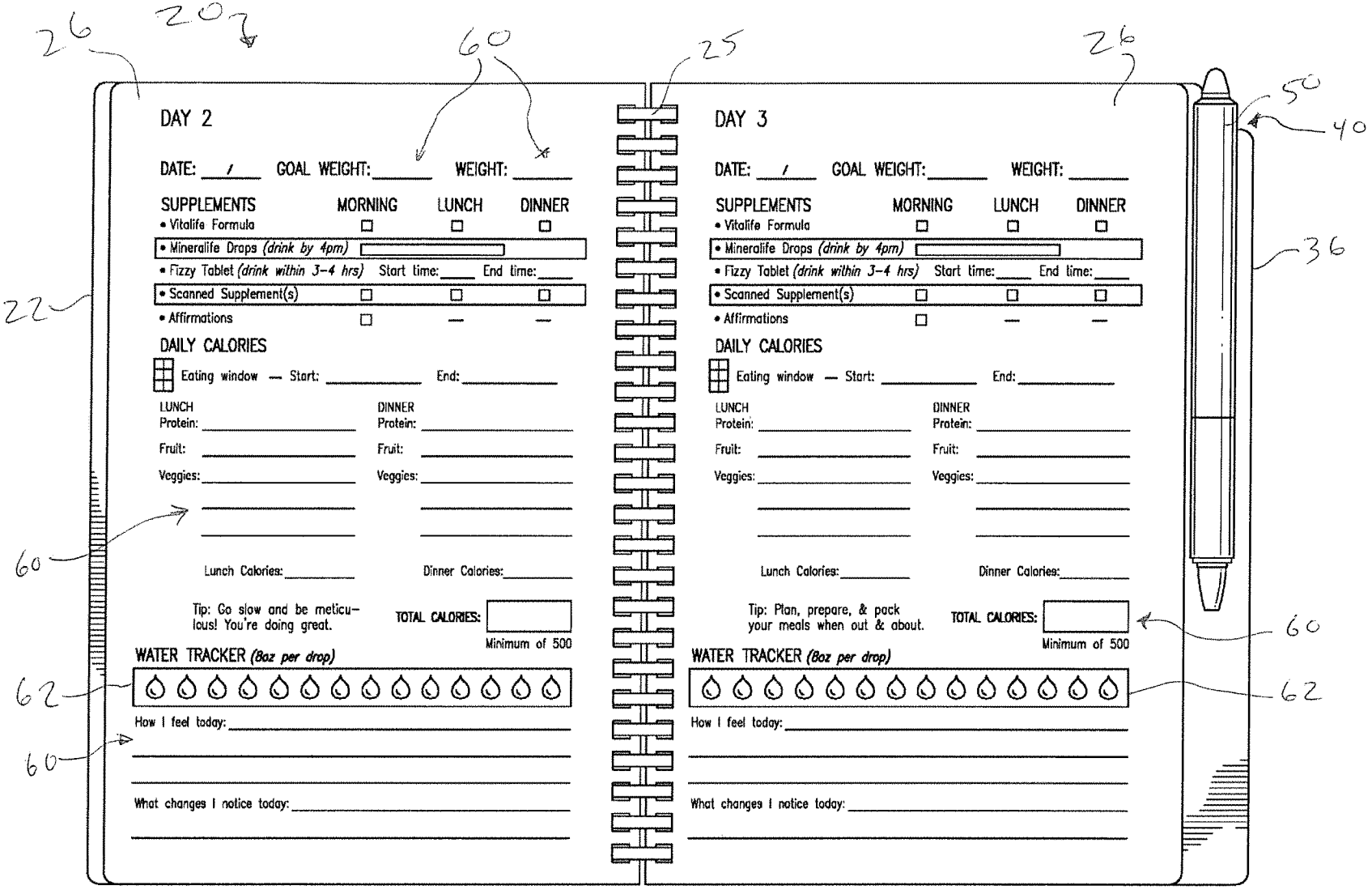
FIG. 8 shows an open view of the journal book of FIG. 1.

The book 20 can provide any type of journal, such as including black and/or preprinted pages. In embodiments of the invention, the journal book 20 is a weight loss journal that includes daily record entry spaces 60 for, without limitation, food, water, and supplement intakes. As shown in FIG. 8, the pages can includes entry areas for recording dates, actual and goal weights, supplements, calories, and meal notes for mealtimes, calorie entries and/or calculations, health tips, and spaces for various notes. The pages further include a water tracker 62, whereby each, for example, eight ounces of water can be marked until the daily tracker is complete or fulfilled. In addition, the journal book 20 can be separated into different sections or rounds of the weight loss or exercise program, such as three distinct rounds of guided dietary plans each independently including a predetermined number of days, weeks, etc., and with a plurality of pages differing in form and/or content from the other rounds.

In embodiments of this invention, the plurality of pages 26 are or include wet erase sheets. Likewise, the pen 50 is a wet erase writing instrument clipped to the pen catch 40. Using wet erase sheet material provides the journal with reusable daily record entry spaces. The ink from the pen dries to the touch, but any mark or writing can be removed from the pages by wetting, such as by running water over the entire page(s) without damage to the page. Exemplary wet erase pens contain water-soluble dyes and can only be removed with a damp tissue or cloth, such as using a paste-based ink rather than alcohol based, which makes their markings semi-permanent. Wet erase sheets can be any suitable polymer film, laminate or impregnated sheet. The journal can also include a refastenable comb binding, where the plurality of pages are removable from the binding, such as for washing or addition, replacement, etc.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A journal book, comprising:

a front cover, a back cover, and a binding securing a first front edge of the front cover to a corresponding first back edge of the back cover;

a plurality of pages secured to the binding between the front cover and the back cover;

the back cover comprising an extension at a second back edge and extending beyond the plurality of pages, the extension having an outer peripheral edge; and a pen catch in the extension of the back cover, wherein the pen catch comprises a notch in the extension, wherein the notch is between a first edge portion of the outer peripheral edge and a second edge portion of the outer peripheral edge, the second edge portion spaced apart from and parallel to the first edge portion, and the notch is configured to receive a clip of a writing instrument between the first edge portion and the second edge portion.

2. The journal book of claim 1, wherein the pen catch is integral with the back cover.

3. The journal book of claim 1, wherein the extension extends beyond a correspondingly aligned second front edge of the front cover, wherein the extension edge is nonparallel relative to the second front edge.

4. The journal book of claim 1, wherein the extension is colinear with the back cover.

5. The journal book of claim 1, wherein the extension extends along a full length of the back cover.

6. The journal book of claim 1, wherein the extension is disposed at a second back edge that is opposite the first back edge.

7. The journal book of claim 1, wherein the undulation cutout extends across a corner intersection of the extension edge and a second extension edge.

8. The journal book of claim 1, wherein the binding comprises a refastenable comb binding, and the plurality of pages are removable from the binding.

9. The journal book of claim 1, wherein the plurality of pages comprises wet erase sheets.

10. The journal book of claim 1, further comprising a wet erase writing instrument clipped to the pen catch.

11. The journal book of claim 1, further comprising a weight loss journal, wherein the weight loss journal comprises reusable daily record entry spaces for food, water, and supplement intakes.

12. The journal book of claim 11, wherein the weight loss journal comprises three distinct rounds of guided dietary plans.

13. A journal book, comprising:

a front cover, a back cover, and a binding securing a first front edge of the front cover to a corresponding first back edge of the back cover, wherein the back cover comprises an extension extending beyond a corresponding front edge of the front cover, and a pen catch formed in the extension, wherein the extension includes an outer peripheral edge with a first extension edge portion and a second extension edge portion, the second edge portion spaced apart from and parallel to the first edge portion, and the pen catch comprises a notch in the extension of the back cover, wherein the notch comprises an undulation between the first edge portion of the outer peripheral edge and the second edge portion of the outer peripheral edge at an intersection of, and extending between, the first edge portion and the second edge portion, and the undulation is configured to receive a clip of a writing instrument between the first edge portion and the second edge portion;

a plurality of wet erase pages secured to the binding between the front cover and the back cover; and a wet erase pen including a pen body and a clip extending therefrom, wherein the pen is clipped on the pen catch with a portion of the extension between the clip and the pen body.

14. The journal book of claim 13, wherein the extension is colinear with the back cover.

15. The journal book of claim 14, wherein the extension extends along a full length of the back cover.

16. The journal book of claim 13, wherein the wet erase pages comprise recordable entry spaces for daily weight, calorie intake, water intake, and supplement intake.

17. The journal book of claim 13, wherein the recordable entry spaces comprise entries labeled across a predetermined timeframe.

18. A journal book, comprising:

a front cover including a front cover edge;

a back cover including a first back cover edge and a second back cover edge;

a binding securing the front cover edge to the first back cover edge;

a plurality of pages secured to the binding between the front cover and the back cover;

the back cover including an extension at the second back cover edge, the extension including an outer peripheral extension edge extending beyond the plurality of pages; and a pen catch in the extension of the back cover, wherein the pen catch comprises a notch in the extension, wherein the notch is formed as a recess between a first edge portion of the outer peripheral extension edge and a second edge portion of the outer peripheral extension edge, the second edge portion spaced apart from and parallel to the first edge portion, and the notch is configured to receive and secure a clip of a writing instrument within the recess and between the first edge portion and the second edge portion.

19. The journal book of claim 18, wherein the extension extends along a full length of the back cover.

20. The journal book of claim 18, wherein the extension is colinear with the back cover.

* * * * *